US009298159B2

(12) United States Patent
Mitorida et al.

(10) Patent No.: US 9,298,159 B2
(45) Date of Patent: Mar. 29, 2016

(54) REMOVAL MECHANISM AND IMAGE FORMING APPARATUS

(71) Applicant: FUJI XEROX CO., LTD., Tokyo (JP)

(72) Inventors: Shinya Mitorida, Kanagawa (JP); Satoru Nishikawa, Kanagawa (JP); Akira Numazaki, Kanagawa (JP); Satoshi Takada, Kanagawa (JP); Taichi Fuchu, Kanagawa (JP); Hirotake Eguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/295,654

(22) Filed: Jun. 4, 2014

(65) Prior Publication Data

US 2015/0098724 A1 Apr. 9, 2015

(30) Foreign Application Priority Data

Oct. 7, 2013 (JP) ..... 2013-210369

(51) Int. Cl.
*G03G 21/20* (2006.01)
*G03G 15/16* (2006.01)
*G03G 21/12* (2006.01)

(52) U.S. Cl.
CPC ..... *G03G 21/206* (2013.01); *G03G 15/161* (2013.01); *G03G 21/12* (2013.01); *G03G 2215/1661* (2013.01)

(58) Field of Classification Search
CPC . G03G 15/161; G03G 21/007; G03G 21/169; G03G 2221/0005; G03G 21/206; G03G 2221/1645
USPC ..... 399/92, 98, 99, 123
See application file for complete search history.

(56) References Cited

U.S. PATENT DOCUMENTS 4,540,268 A * 9/1985 Toyono et al. ..... 399/93

FOREIGN PATENT DOCUMENTS

| | | |
|---|---|---|
| JP | A-2001-194981 | 7/2001 |
| JP | A-2005-195907 | 7/2005 |
| JP | A-2007-271890 | 10/2007 |

* cited by examiner

*Primary Examiner* — Erika J Villaluna
(74) *Attorney, Agent, or Firm* — Oliff PLC

(57) ABSTRACT

A removal mechanism includes a removing member, an accommodation section, a receiver, and a cooling path. The removing member rubs against an extraneous-matter-adhered member, to which extraneous matter is adhered, so as to remove the extraneous matter therefrom. The accommodation section accommodates therein the extraneous matter removed by the removing member. The receiver receives, at a lower side of the accommodation section, the extraneous matter spilling out and dropping from the accommodation section. The cooling path allows gas so flow therethrough so as to cool the accommodation section from outside thereof. The cooling path is spatially isolated from a passage chamber through which the extraneous matter dropping from the accommodation section toward the receiver passes, an accommodation chamber for the extraneous matter in the accommodation section, and a chamber above the receiver that receives the extraneous matter.

6 Claims, 8 Drawing Sheets

REMOVAL MECHANISM AND IMAGE FORMING APPARATUS

CROSS-REFERENCE TO RELATED APPLICATIONS

This application is based on and claims priority under 35 USC 119 from Japanese Patent Application No. 2013-210369 filed Oct. 7, 2013.

BACKGROUND

Technical Field

The present invention relates to removal mechanisms and image forming apparatuses.

SUMMARY

According to an aspect of the invention, there is provided a removal mechanism including a removing member, an accommodation section, a receiver, and a cooling path. The removing member rubs against an extraneous-matter-adhered member, to which extraneous matter is adhered, so as to remove the extraneous matter therefrom. The accommodation section accommodates therein the extraneous matter removed by the removing member. The receiver receives, at a lower side of the accommodation section, the extraneous matter spilling out and dropping from the accommodation section. The cooling path allows gas to flow therethrough so as to cool the accommodation section from outside thereof. The cooling path is spatially isolated from a passage chamber through which the extraneous matter dropping from the accommodation section toward the receiver passes, an accommodation chamber for the extraneous matter in the accommodation section, and a chamber above the receiver that receives the extraneous matter.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Configuration of Image Forming Apparatus 10

Figure 1:
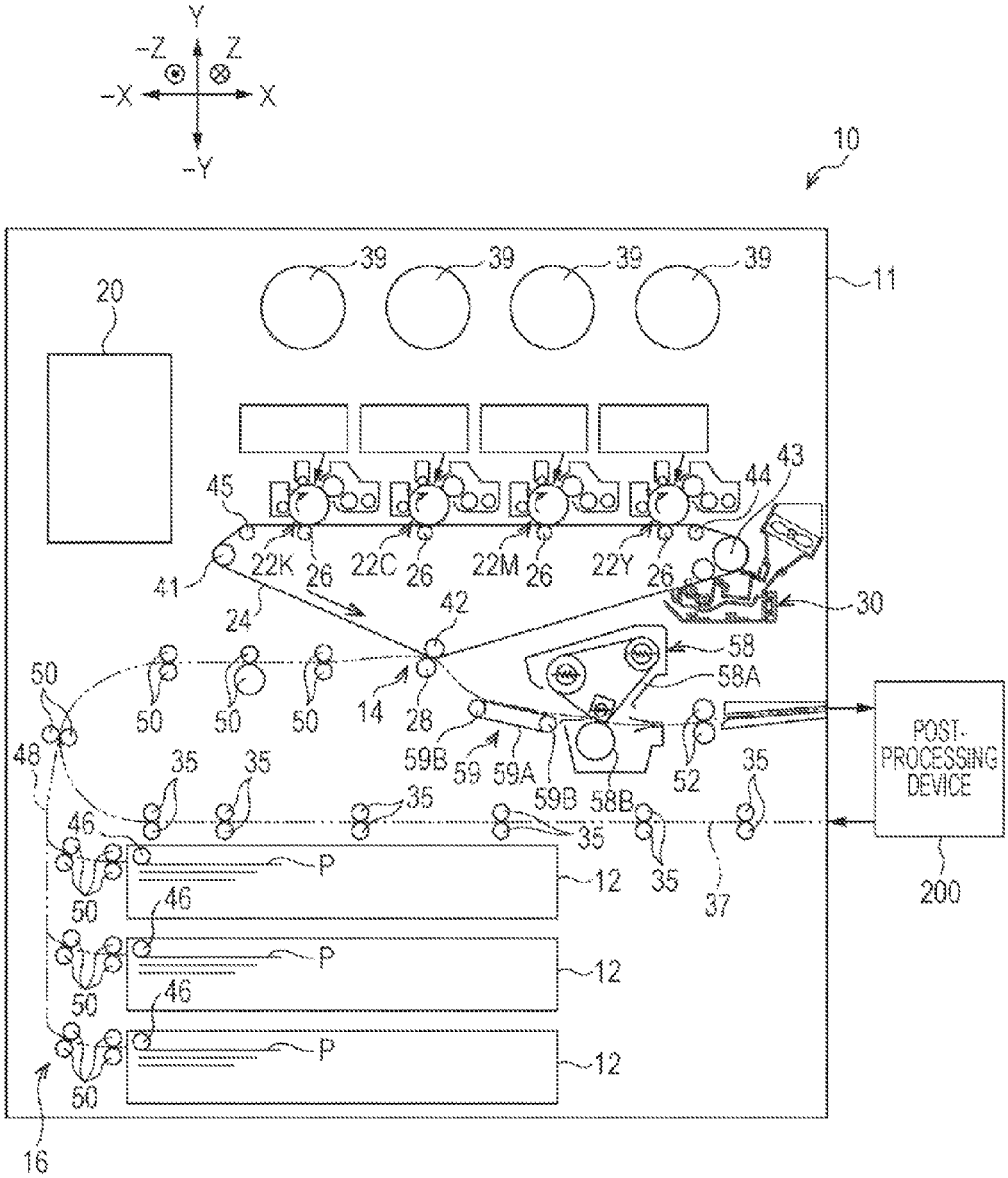
FIG. 1 schematically illustrates the configuration of an image forming apparatus according to an exemplary embodiment.

First, the configuration of an image forming apparatus 10 according to this exemplary embodiment will be described. FIG. 1 schematically illustrates the configuration of the image forming apparatus 10. In the following description, an X direction, a −X direction, a Y direction, a −Y direction, a Z direction, and a −Z direction are directions indicated by respective arrows in each of the drawings. Furthermore, in each of the drawings, a circle with an "x" therein indicates an arrow extending from the near side toward the far side of the plane of the drawing, and a circle with a dot in the center indicates an arrow extending from the far side toward the near side of the plane of the drawing.

As shown in FIG. 1, the image forming apparatus 10 includes an image-forming-apparatus body 11 (housing) that accommodates components therein. The image-forming-apparatus body 11 is provided with multiple accommodation sections 12 that accommodate recording media P, such as sheets, therein, an image forming section 14 that forms an image onto a recording medium P, a transport section 16 that transports a recording medium P from each of the accommodation sections 12 toward the image forming section 14, and a controller 20 that controls the operation of each section of the image forming apparatus 10.

The image forming section 14 includes image forming units 22Y, 22M, 22C, and 22K (which will be referred to as "image forming units 22Y to 22K" hereinafter) that respectively form yellow (Y), magenta (M), cyan (C), and black (K) toner images, an intermediate transfer belt 24 onto which the toner images formed by the image forming units 22Y to 22K are transferred, first transfer rollers 26 that transfer the toner images formed by the image forming units 22Y to 22K onto the intermediate transfer belt 24, and a second transfer roller 28 that transfers the toner images transferred on the intermediate transfer belt 24 by the first transfer rollers 26 onto a recording medium P from the intermediate transfer belt 24. The image forming section 14 is not limited to the above-described configuration and may have another configuration so long as the image forming section 14 is configured to form an image onto a recording medium P.

Figure 2:
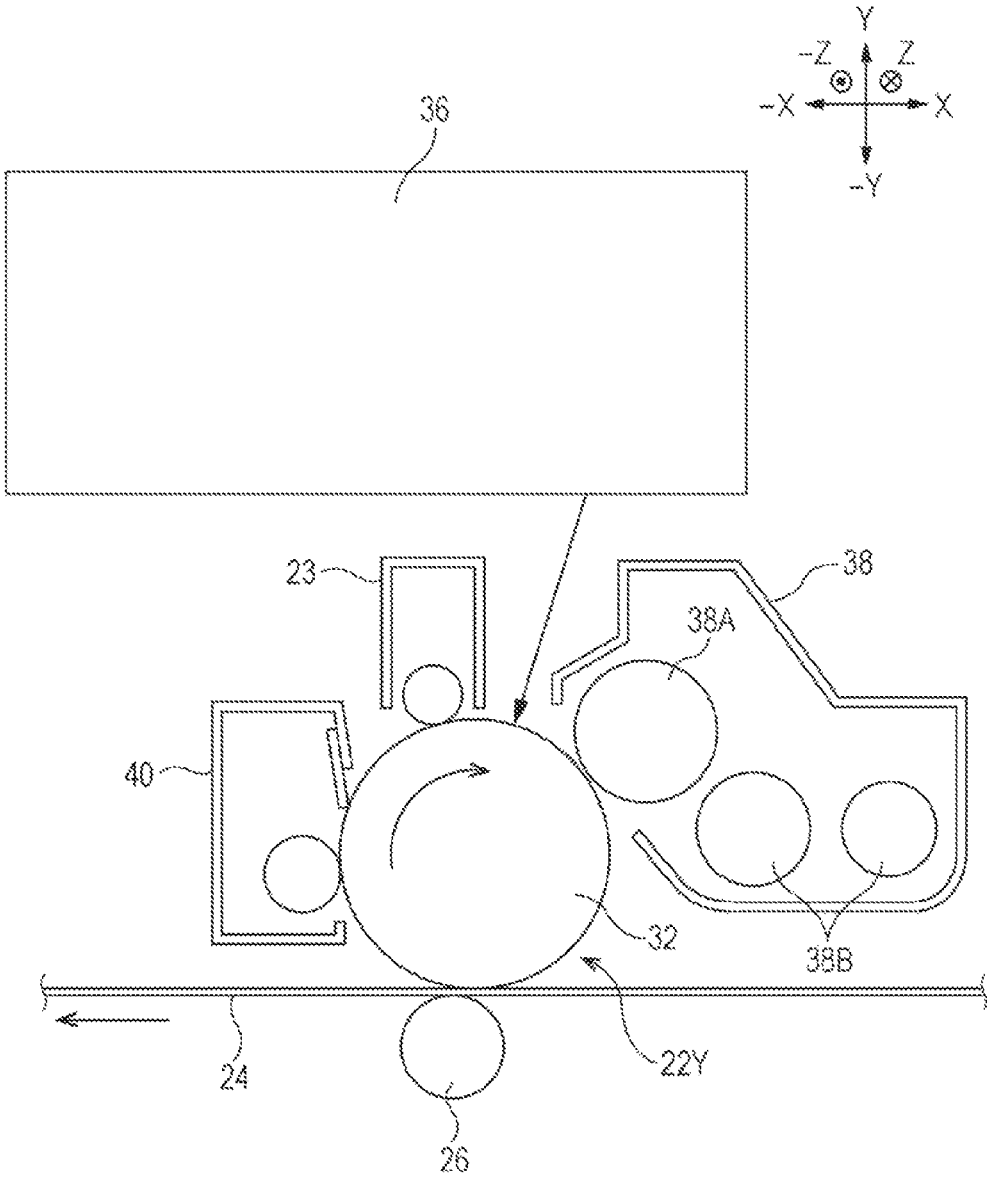
FIG. 2 schematically illustrates the configuration of an image forming unit according to this exemplary embodiment.

The image forming units 22Y to 22K are arranged in the X direction at the Y side (i.e., upper side) of the intermediate transfer belt 24. Furthermore, as shown in FIG. 2, each of the image forming units 22Y to 22K has a photoconductor 32 that rotates in one direction (e.g., clockwise direction in FIG. 2). Because the image forming units 22Y to 22K have identical configurations, FIG. 2 illustrates the configuration of the image forming unit 22Y as a representative unit of the image forming units 22Y to 22K.

In the following order from the upstream side of each photoconductor 32 in the rotational direction thereof, the photoconductor 32 is surrounded by a charging device 23 that electrostatically charges the photoconductor 32, an exposure device 36 that exposes the photoconductor 32 electrostatically charged by the charging device 23 to light so as to form an electrostatic latent image on the photoconductor 32, a developing device 38 that develops the electrostatic latent image formed on the photoconductor 32 by the exposure device 36 so as to form a toner image, and a removal device 40 that comes into contact with the photoconductor 32 so as to remove residual toner from the photoconductor 32.

The exposure device 36 is configured to form the electrostatic latent image based on an image signal transmitted from the controller 20 (see FIG. 1). An example of the image signal transmitted from the controller 20 is an image signal acquired by the controller 20 from an external device.

The developing device 38 includes a developer feed member 38A that feeds a developer to the photoconductor 32, and multiple transport members 38B that transport the developer to be provided to the developer feed member 38A while stirring the developer.

As shown in FIG. 1, toner accommodation sections 39 that accommodate toners to be supplied to the developing devices 38 of the image forming units 22Y to 22K are provided above the respective exposure devices 36.

The intermediate transfer belt 24 has an annular shape and is disposed at the −Y side (lower side) of the image forming units 22Y to 22K. Support rollers 41, 42, 43, 44, and 45 around which the intermediate transfer belt 24 is wrapped are provided within the inner periphery of the intermediate transfer belt 24. For example, when the support roller 43 is rotationally driven, the intermediate transfer belt 24 rotates in one direction (e.g., counterclockwise direction in FIG. 1) while being in contact with the photoconductors 32. Thus, the intermediate transfer belt 24 is configured to bear the toner images transferred from the image forming units 22Y to 22K and to transport the toner images. Specifically, the intermediate transfer belt 24 functions as an example of a bearing member that bears toner to be transferred onto a recording medium. The support roller 42 is an opposed roller that is opposed to the second transfer roller 28.

A removal mechanism 30 that removes extraneous matter adhered on the intermediate transfer belt 24 is provided below the support roller 43. A detailed configuration of this removal mechanism 30 will be described later.

The first transfer rollers 26 are opposed to the photoconductors 32 with the intermediate transfer belt 24 interposed therebetween. The positions between the first transfer rollers 26 and the photoconductors 32 are first transfer positions where the toner images formed on the photoconductors 32 are transferred onto the intermediate transfer belt 24.

The second transfer roller 28 is opposed to the support roller 42 with the intermediate transfer belt 24 interposed therebetween. The position between the second transfer roller 28 and the support roller 42 is a second transfer position where the toner images transferred on the intermediate transfer belt 24 is transferred onto a recording medium P.

The transport section 16 is provided with feed rollers 46 that feed recording media P from the accommodation sections 12, a transport path 48 used for transporting a recording medium P fed by each feed roller 46, and multiple transport rollers 50 that are arranged along the transport path 48 and that transport the recording medium P fed by each feed roller 46 toward the second transfer position.

A transport member 59 that transports the recording medium P having the toner images transferred thereon by the second transfer roller 28 is provided at the downstream side of the second transfer position in the transport direction. The transport member 59 has an annular (endless) transfer belt 59A and a pair of rollers 59B around which the transfer belt 59A is wrapped. In a state where the recording medium P is held on the outer peripheral surface of the transfer belt 59A, at least one of the two rollers 59B is rotationally driven so that the recording medium P is transported toward a fixing device 58, which will be described below.

The fixing device 58 is provided at the downstream side of the transport member 59 in the transport direction and is configured to fix the toner images transferred on the recording medium P by the second transfer roller 28 onto the recording medium P. The fixing device 58 fixes the toner images onto the recording medium P transported from the transport member 59 by using a fixing belt 58A to heat the recording medium P and by using a pressing roller 58B to apply pressure onto the recording medium P.

A discharge roller 52 is provided at the downstream side of the fixing device 58 in the transport direction and is configured to discharge the recording medium P having the toner images fixed thereon from the image-forming-apparatus body 11 toward a post-processing device 200. The post-processing device 200 includes, for example, a cooling section (not shown) that cools the recording medium P, a correcting section (not shown) that corrects bending of the recording medium P, and an inspecting section (not shown) that inspects the image formed on the recording medium P.

Furthermore, a transport path 37 is disposed downstream of the fixing device 58 and upstream of the accommodation sections 12 and is used for returning the recording medium P having the toner images fixed on one face thereof to the second transfer position again. The recording medium P discharged toward the post-processing device 200 by the discharge roller 52 is inverted by the post-processing device 200 and is transported to the transport path 37. The recording medium P transported to the transport path 37 is further transported toward the second transfer position by multiple transport rollers 35 arranged along the transport path 37.

Image Forming Operation

Next, image forming operation for forming an image onto a recording medium P in the image forming apparatus 10 according to this exemplary embodiment will be described.

In the image forming apparatus 10 according to this exemplary embodiment, a recording medium P fed by the feed roller 46 from one of the accommodation sections 12 is transported toward the second transfer position by the multiple transport rollers 50.

In the image forming units 22Y to 22K, the photoconductors 32 electrostatically charged by the charging devices 23 are exposed to light by the exposure devices 36, so that electrostatic latent images are formed on the photoconductors 32. The electrostatic latent images are developed by the developing devices 38 so that toner images are formed on the photoconductors 32. The toner images of the respective colors formed at the image forming units 22Y to 22K are superimposed onto the intermediate transfer belt 24 at the first transfer positions, whereby a color image is formed. Then, the color image formed on the intermediate transfer belt 24 is transferred onto the recording medium P at the second transfer position.

The recording medium P having the toner image transferred thereon is transported to the fixing device 58 by the transport member 59. The fixing device 58 fixes the transferred toner image onto the recording medium P. The recording medium P having the toner image fixed thereon is discharged from the image-forming-apparatus body 11 to the post-processing device 200 by the discharge roller 52. The image forming operation is performed in the above-described manner.

Configuration of Removal Mechanism 30

Figure 3:
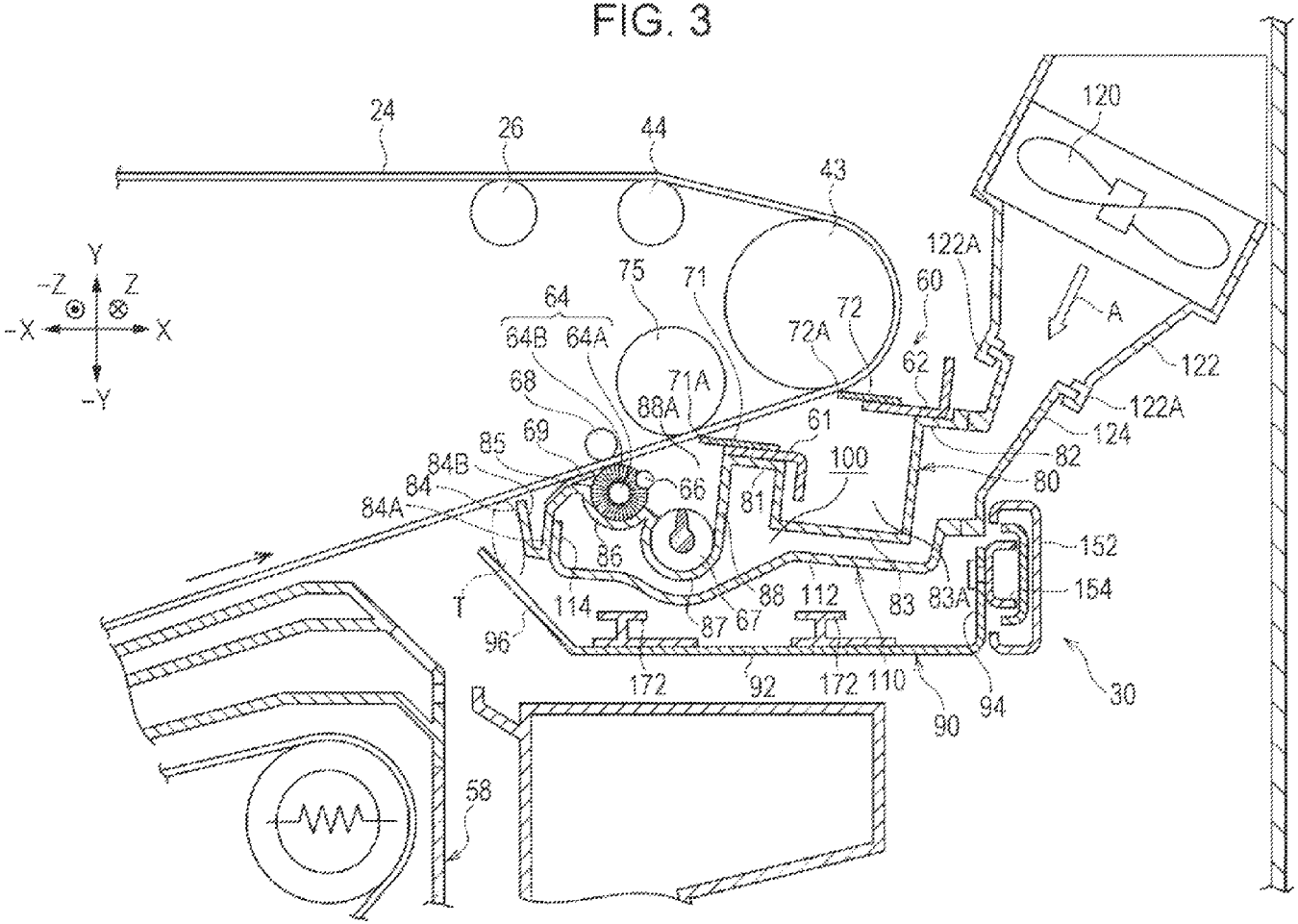
FIG. 3 is a cross-sectional view illustrating the configuration of a removal mechanism according to this exemplary embodiment.

Next, the configuration of the removal mechanism 30 will be described. FIG. 3 is a cross-sectional view illustrating the configuration of the removal mechanism 30.

As shown in FIG. 3, the removal mechanism 30 includes a removal device 60 that removes extraneous matter adhered on the intermediate transfer belt 24 (as an example of an extraneous-matter-adhered member). The removal device 60 includes a housing 80 that accommodates various components therein. The housing 80 is formed of, for example, a metal plate and opens toward the intermediate transfer belt 24 (i.e., toward the Y side). The housing 80 is provided with a brush 64 (as an example of a removing member), a first blade 71 (as an example of a removing member), and a second blade 72 (as an example of a removing member).

The brush 64 has a shaft portion 64A and a brush portion 64B provided around the entire periphery of the shaft portion 64A. The shaft portion 64A is rotatably supported by the housing 80. The brush 64 rotates when the shaft portion 64A is rotationally driven by a driver (not shown). For example, the brush 64 is configured to rotate along the intermediate transfer belt 24 (i.e., in a clockwise direction in FIG. 3) at a peripheral velocity higher than that of the intermediate transfer belt 24. Thus, the brush 64 loosens the extraneous matter adhered on the outer peripheral surface of the intermediate transfer belt 24 and peels off a portion of the extraneous matter therefrom.

The extraneous matter adhered on the intermediate transfer belt 24 includes residual toner remaining on the intermediate transfer belt 24 without being transferred onto the recording medium P at the second transfer position, an external additive contained in the developer, and fine particles, such as particles from the recording medium P (i.e., paper particles).

An opposed roller 68 is opposed to the brush 64 with the intermediate transfer belt 24 interposed therebetween. The opposed roller 68 supports a load received by the intermediate transfer belt 24 from the brush 64. The housing 80 is also provided with a dropper portion 66 that abuts on the brush portion 64B of the rotating brush 64 and flicks the brush portion 64B so as to cause the extraneous matter adhered to the brush portion 64B to drop therefrom.

The first blade 71 is disposed on the outer periphery of the intermediate transfer belt 24 and is located downstream of the brush 64 in the rotational direction of the intermediate transfer belt 24. The first blade 71 is rectangular in cross section. A Y-side edge 71A of a −X-side end (distal end) of the first blade 71 is in contact with the outer peripheral surface of the intermediate transfer belt 24.

Thus, the edge 71A of the first blade 71 rubs against the outer peripheral surface of the rotating intermediate transfer belt 24 so as to scrape off therefrom the extraneous matter not removed by the brush 64. The first blade 71 is composed of, for example, rubber or metal.

An X-side end (base end) of the first blade 71 is supported by a first support member 61 that is L-shaped when viewed in the Z direction. The first support member 61 is composed of, for example, a metallic material such as a metal plate.

An opposed roller 75 is opposed to the first blade 71 with the intermediate transfer belt 24 interposed therebetween. The opposed roller 75 supports a load received by the intermediate transfer belt 24 from the first blade 71.

A transport member 67 (auger) is provided at the −Y side (i.e., lower side) of the edge 71A of the first blade 71. The transport member 67 transports, in the Z direction, extraneous matter scraped off by and dropping from the edge 71A of the first blade 71 as well as extraneous matter dropping from the brush 64 via the dropper portion 66. The transport member 67 is configured to transport the extraneous matter to a discharge portion (not shown) disposed at the Z side of the transport member 67.

The second blade 72 is disposed on the outer periphery of the intermediate transfer belt 24 and is located downstream of the first blade 71 in the rotational direction of the intermediate transfer belt 24. The second blade 72 is rectangular in cross section. A Y-side edge 72A of a −X-side end (distal end) of the second blade 72 is in contact with the outer peripheral surface of the intermediate transfer belt 24.

Thus, the edge 72A of the second blade 72 rubs against the outer peripheral surface of the rotating intermediate transfer belt 24 so as to scrape off therefrom the extraneous matter not removed by the first blade 71. The second blade 72 is composed of, for example, rubber or metal.

An X-side end (base end) of the second blade 72 is supported by a second support member 62 that is L-shaped when viewed in the Z direction. The second support member 62 is composed of, for example, a metallic material such as a metal plate.

The aforementioned support roller 43 is opposed to the second blade 72 with the intermediate transfer belt 24 interposed therebetween. The support roller 43 supports a load received by the intermediate transfer belt 24 from the second blade 72.

The housing 80 has a first attachment portion 81 that constitutes a mid-portion of the housing 80 in the X direction and to which the first support member 61 is attached, and a second attachment portion 82 that constitutes a side portion of the housing 80 in the X direction and to which the second support member 62 is attached. Each of the first attachment portion 81 and the second attachment portion 82 is constituted of a plate (wall) whose thickness direction is aligned with the Y direction.

Moreover, the housing 80 has a U-shaped connection portion 83 that connects an X-side end of the first attachment portion 81 and a −X-side end of the second attachment portion 82. The connection portion 83 forms an accommodation chamber 83A that accommodates therein extraneous matter scraped off by and dropping from the second blade 72.

Furthermore, the housing 80 has a V-shaped portion 84 that constitutes a −X-side portion of the housing 80 and that is V-shaped when viewed in the Z direction. The X side of the V-shaped portion 84 is provided with an inclined portion 85 that is inclined in the X direction from a Y-side end (upper end) of an X side 84A of the V-shaped portion 84 toward the Y side (upward). The surface of the inclined portion 85 facing the intermediate transfer belt 24 is provided with a seal member 69 that suppresses spillage of extraneous matter from an accommodation chamber 85A, which will be described later. A −X-side end of the seal member 69 is fixed to the inclined portion 85 such that the seal member 69 extends in the X direction from the inclined portion 85, and an X-side end of the seal member 69 is in contact with the outer peripheral surface of the intermediate transfer belt 24. The seal member 69 is formed of, for example, a film.

The X side of the inclined portion 85 is provided with a first curved portion 86 that is curved into a circular-arc shape along a part of the outer periphery of the brush 64. The X side of the first curved portion 86 is provided with a second curved portion 87 that is curved into a circular-arc shape along a part of the outer periphery of the transport member 67.

The Y side (upper side) of the second curved portion 87 is provided with an extension portion 88 that extends in the Y direction (upward) from a Y-side end (upper end) of the second curved portion 87. A Y-side end (upper end) of the extension portion 88 and a −X-side end of the first attachment portion 81 are connected to each other.

In the housing 80, the first curved portion 86, the second curved portion 87, and the extension portion 88 constitute an accommodation chamber 88A that accommodates therein the extraneous matter scraped off by and dropping from the edge 71A of the first blade 71 and the extraneous matter dropping from the brush 64 via the dropper portion 66. Accordingly, the housing 80 is configured to function as an example of an accommodation section that accommodates therein extraneous matter removed by the first blade 71, the second blade 72, and the brush 64. As described above, the extraneous matter accommodated in the accommodation chamber 88A is transported to the discharge portion (not shown) by the transport member 67.

The −Y side (lower side) of the housing 80 is provided with a receiver 90 that receives extraneous matter spilling out and dropping in the −X direction from the −X-side end (i.e., the V-shaped portion 84) of the housing 80. The receiver 90 is formed of a plate-shaped member composed of, for example, a resin material or a metallic material. Specifically, the receiver 90 has a body portion 92 extending in the X direction when viewed in the Z direction, an extension portion 94 extending in the Y direction (upward) from an X-side end of the body portion 92, and an inclined portion 96 that is inclined in the −X direction from the −X-side end of the body portion 92 toward the Y side (upward).

A distal end (Y-side end) of the inclined portion 96 extends further in the −X direction than the V-shaped portion 84 such that extraneous matter spilling out in the −X direction from the V-shaped portion 84 is first received by the inclined portion 96 of the receiver 90.

Examples of extraneous matter spilling out in the −X direction from the V-shaped portion 84 includes extraneous matter peeled off from the intermediate transfer belt 24 by the seal member 69 before reaching the brush 64 and extraneous matter accommodated in the accommodation chamber 88A but spilling out in the −X direction over the seal member 69.

The extraneous matter is retained within an internal chamber 84B of the V-shaped portion 84 and spills out in the −X direction from the V-shaped portion 84 when the internal chamber 84B of the V-shaped portion 84 becomes saturated.

Furthermore, the receiver 90 is disposed between the fixing device 58 (i.e., the fixing belt 58A) and the removal device 60, that is, at the Y side (upper side) of the fixing device 58 (i.e., the fixing belt 58A) and at the −Y side (lower side) of the removal device 60. Thus, the receiver 90 also functions as an insulation member that blocks heat transmitted from the fixing device 58 (i.e., the fixing belt 58A) toward the removal device 60.

The components constituting the removal device 60 (such as the housing 80, the brush 64, the first blade 71, the first support member 61, the second blade 72, the transport member 67, and the seal member 69) and the receiver 90 each have a length in the Z direction that corresponds to the length of the intermediate transfer belt 24 in the Z direction.

In this exemplary embodiment, the first blade 71 and the second blade 72 rub against the intermediate transfer belt 24 so as to generate frictional heat. This frictional heat is transmitted to the housing 80 via the first support member 61 and the second support member 62.

A cooling path 100 for cooling this frictional heat is disposed between the housing 80 and the receiver 90. This cooling path 100 is formed by an outer wall of the housing 80 and a constituent member 110 disposed below the housing 80 and is configured to allow gas to flow therethrough so as to cool the housing 80 from the outside thereof.

The constituent member 110 has a length in the Z direction that corresponds to the length of the intermediate transfer belt 24 in the Z direction, and is formed of a plate-shaped member composed of, for example, a resin material or a metallic material. Specifically, the constituent member 110 has a body portion 112 and a fixation portion 114. When viewed in the Z direction, the body portion 112 is disposed facing an area of the housing 80 excluding the V-shaped portion 84 with a gap therebetween in the Y direction. The fixation portion 114 is provided at a −X-side end of the body portion 112 and is fixed to an X-direction-facing surface of the side 84A of the V-shaped portion 84.

In this exemplary embodiment, the constituent member 110 is disposed at the X side of a passage chamber T through which extraneous matter dropping toward the receiver 90 from the housing 80 passes, and the cooling path 100 is displaced in the X direction (i.e., in the lateral direction) relative to the passage chamber T in plan view.

Figure 4:
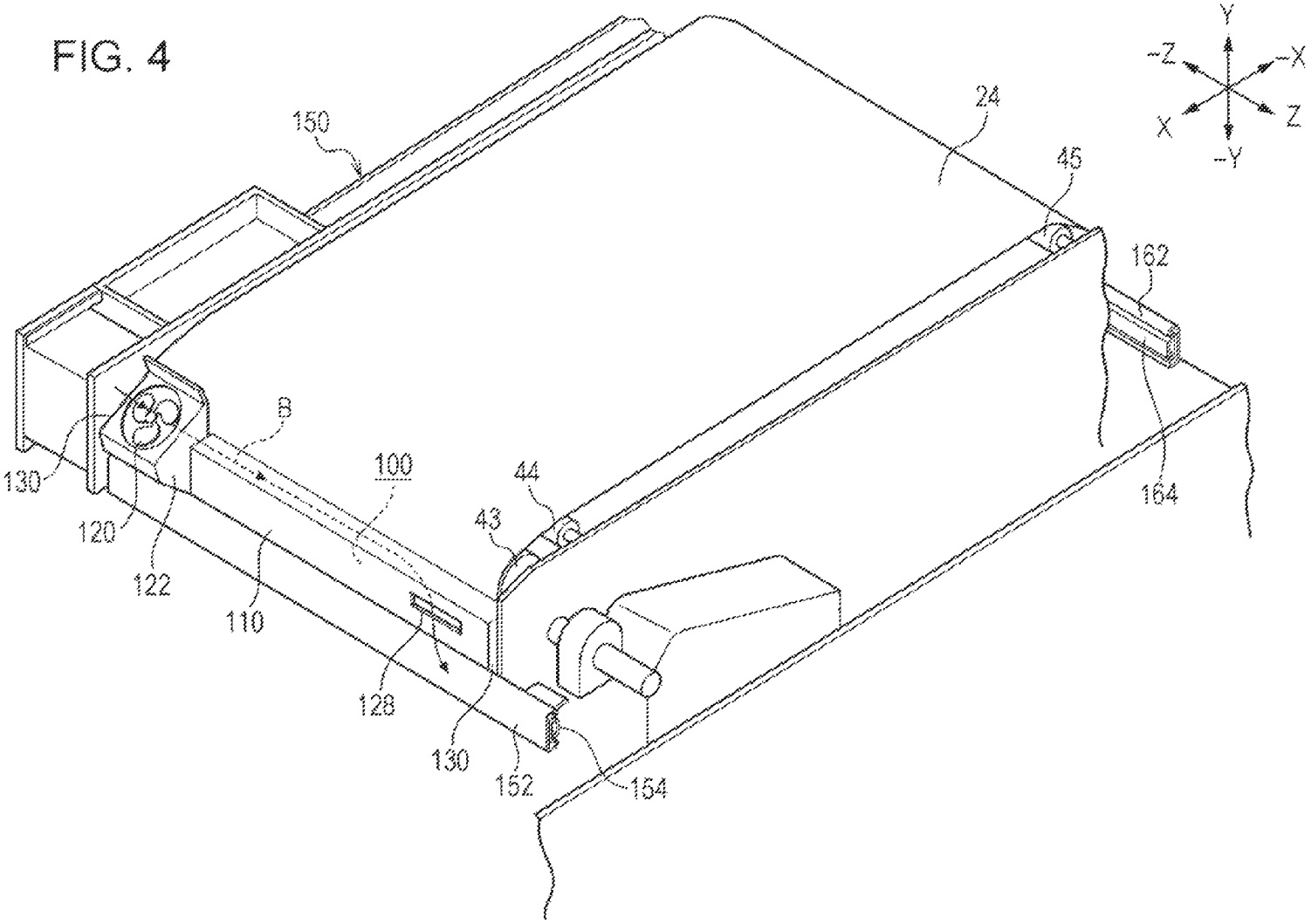
FIG. 4 is a perspective view illustrating the configuration of an intermediate transfer unit according to this exemplary embodiment.

Furthermore, in this exemplary embodiment, a duct 122 provided with a fan 120 as an air-sending unit is disposed at the X side of the support roller 43. As shown in FIG. 4, the duct 122 is disposed at the −Z side of the constituent member 110. The fan 120 takes in outside air existing outside the image-forming-apparatus body 11 and sends the outside air in a direction indicated by an arrow A shown in FIG. 3. In other words, the duct 122 serves as an inlet for taking in outside air into the cooling path 100. The fan 120 may be, for example, a sirocco fan or an axial fan.

A connection duct 124 that connects the duct 122, the housing 80, and the constituent member 110 is provided below the duct 122. The X-side ends of the housing 80 and the constituent member 110 are connected to the lower end of the connection duct 124 in an ejectable manner in the −Z direction. The upper end of the connection duct 124 is supported by a support portion 122A, which is formed at the lower end of the duct 122 and is U-shaped in cross section, in an ejectable manner in the −Z direction.

Furthermore, as shown in FIG. 4, an outlet 128 for discharging the air taken into the cooling path 100 by the fan 120 is provided at the Z side of the housing 80. Therefore, as indicated by an arrow B in FIG. 4, the air taken in by the fan 120 flows in the Z direction through the cooling path 100 and is discharged from the outlet 128. The air discharged from the outlet 128 is discharged outside the image-forming-apparatus body 11 via an exhaust hole (not shown).

Furthermore, sidewalls 130 are provided at the −Z side and the Z side of the housing 80 and the constituent member 110, such that the −Z side and the Z side are closed. Accordingly, the cooling path 100 is a chamber that is enclosed except for the duct 122 as an inlet and the outlet 128. Specifically, as shown in FIG. 3, the cooling path 100 is spatially isolated from the passage chamber T through which extraneous matter dropping from the housing 80 toward the receiver 90 passes, the extraneous-matter accommodation chambers 83A and 88A in the housing 80 (i.e., internal chambers of the housing 80), and the chamber above the receiver 90 that receives extraneous matter (i.e., the chamber between the receiver 90 and the constituent member 110).

Moreover, the constituent member 110 is disposed between the fixing device 58 (i.e., the fixing belt 58A) and the removal device 60, that is, at the Y side (upper side) of the fixing device 58 (i.e., the fixing belt 58A) and at the −Y side (lower side) of the removal device 60. Therefore, together with the receiver 90, the constituent member 110 also functions as an insulation member that blocks heat transmitted from the fixing device 58 (i.e., the fixing belt 58A) toward the removal device 60.

Intermediate Transfer Unit 150

Furthermore, in this exemplary embodiment, an intermediate transfer unit 150 (see FIGS. 4 and 5) that includes the removal device 60, the constituent member 110, the connection duct 124, the receiver 90, and the intermediate transfer belt 24 is ejectable from the image-forming-apparatus body 11.

As shown in FIGS. 3 and 4, a guided member 154 that is guided along a guide member 152 (rail member) provided at the image-forming-apparatus body 11 is provided at the X side of the extension portion 94 of the receiver 90.

Furthermore, as shown in FIG. 4, a guided member 164 that is guided along a guide member 162 (rail member) provided at the image-forming-apparatus body 11 is provided at the −X side of the intermediate transfer unit 150. The guided members 154 and 164 are guided in the −Z direction from the image-forming-apparatus body 11 by the guide members 152 and 162, respectively, so that the intermediate transfer unit 150 is ejected from the image-forming-apparatus body 11.

In this case, the upper end of the connection duct 124 is pulled out in the −Z direction from the support portion 122A, which is U-shaped in cross section, formed at the lower end of the duct 122. In other words, the duct 122 and the fan 120 remain in the image-forming-apparatus body 11 (see FIG. 3).

Figure 5:
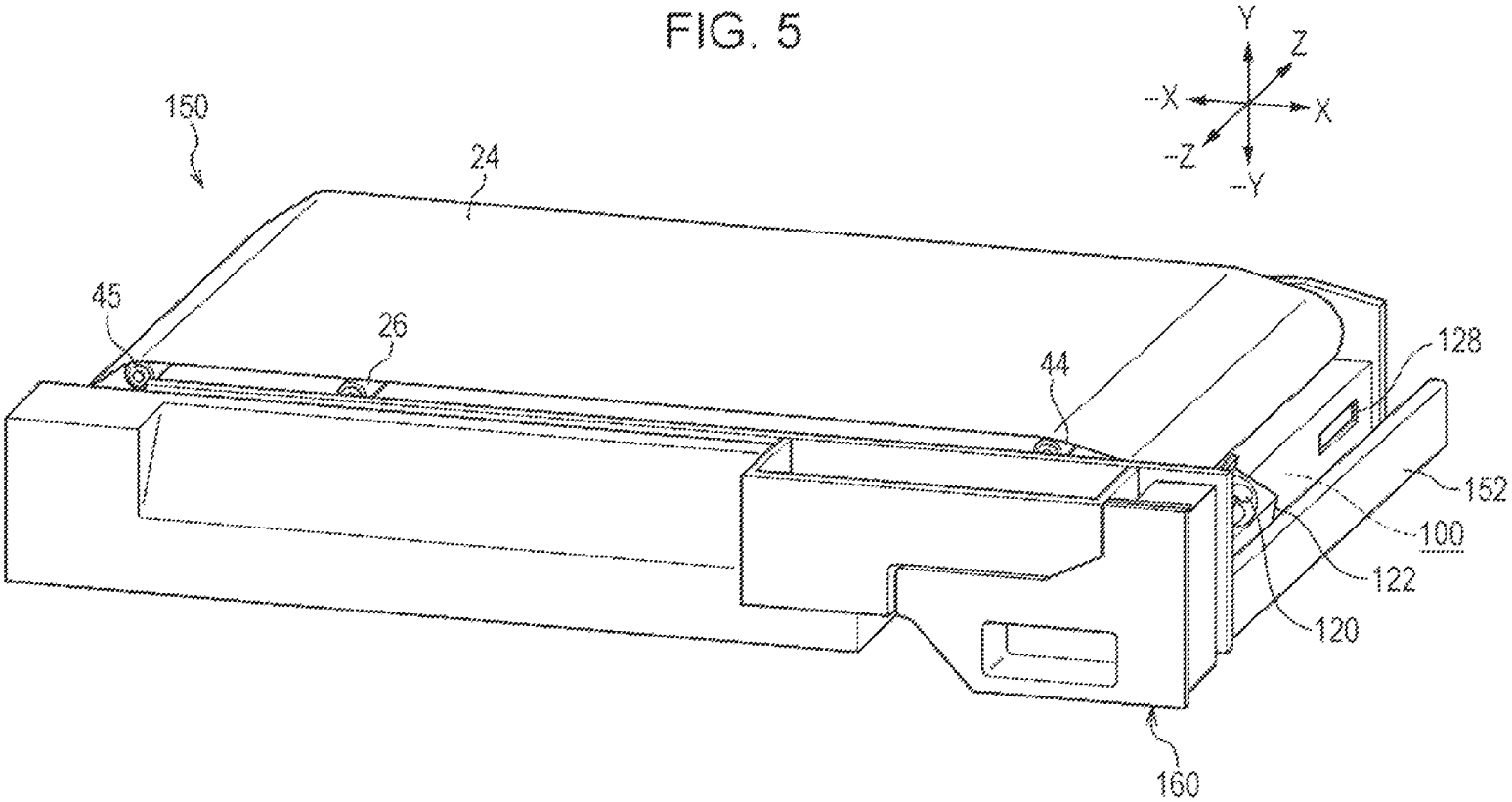
FIG. 5 is a perspective view illustrating the configuration of the intermediate transfer unit according to this exemplary embodiment.
Figure 6:
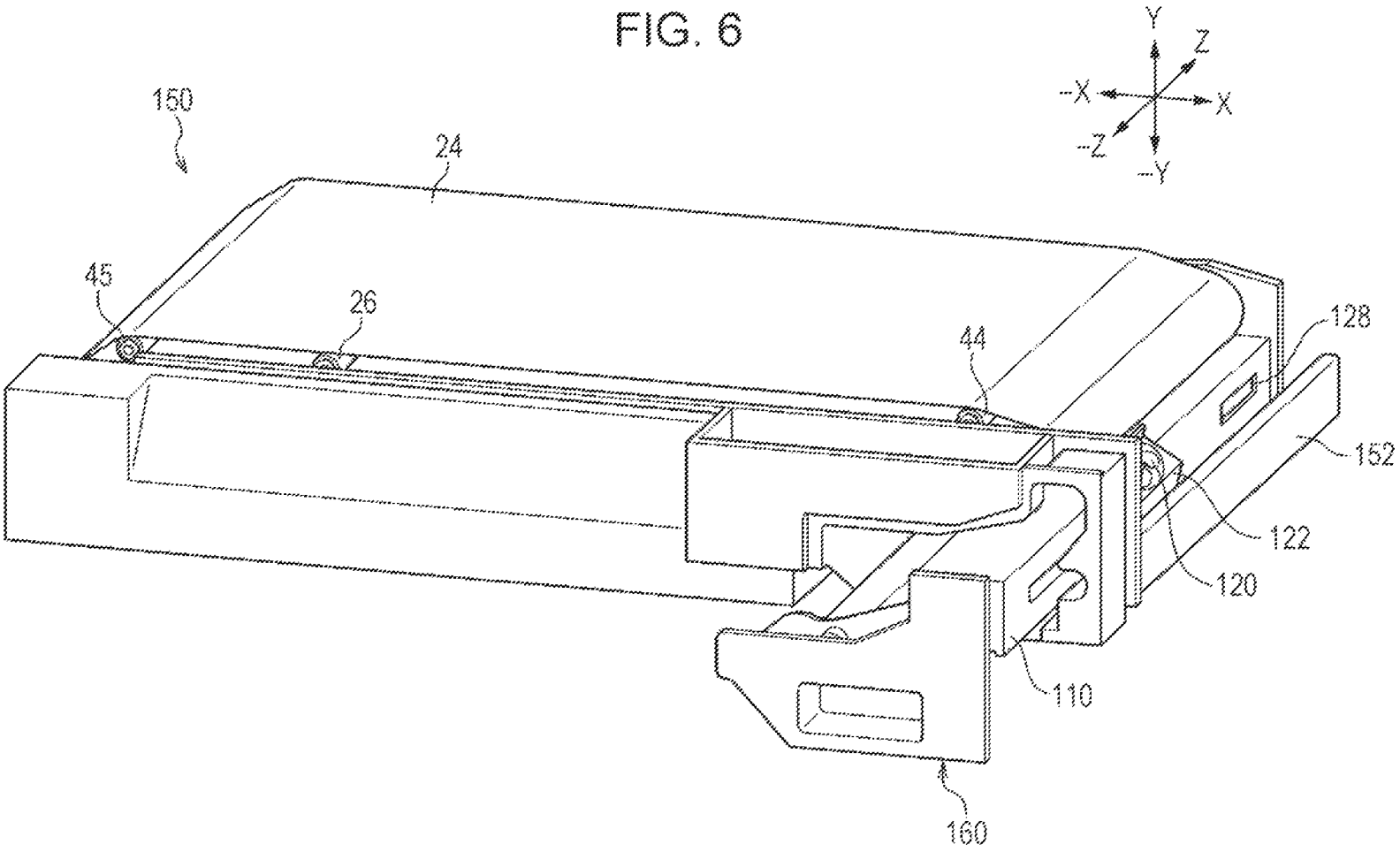
FIG. 6 is a perspective view illustrating a state where a removal device unit is being detached in the configuration shown in FIG. 5.
Figure 7:
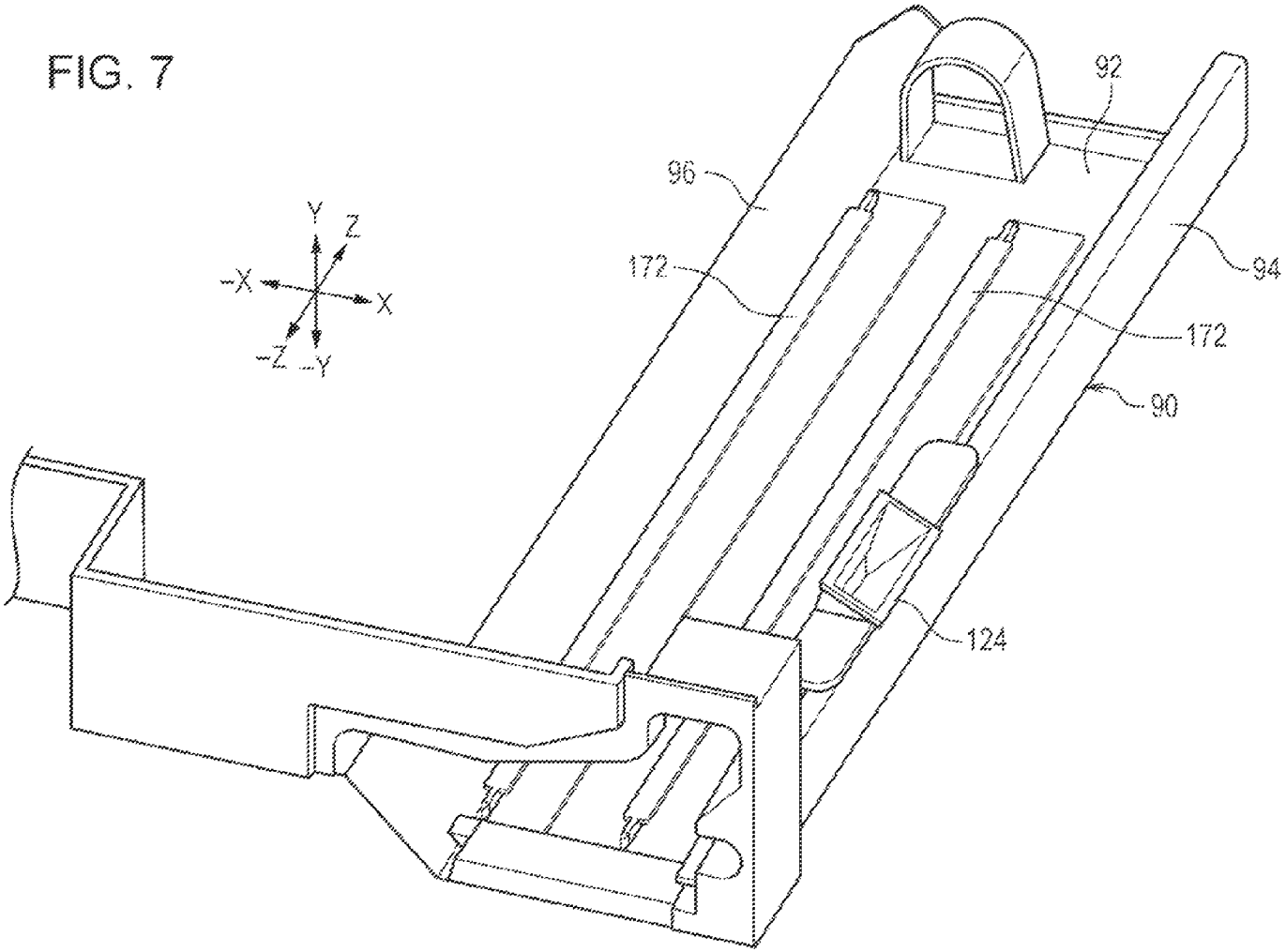
FIG. 7 is a perspective view illustrating the configuration of a receiver according to this exemplary embodiment.
Figure 8:
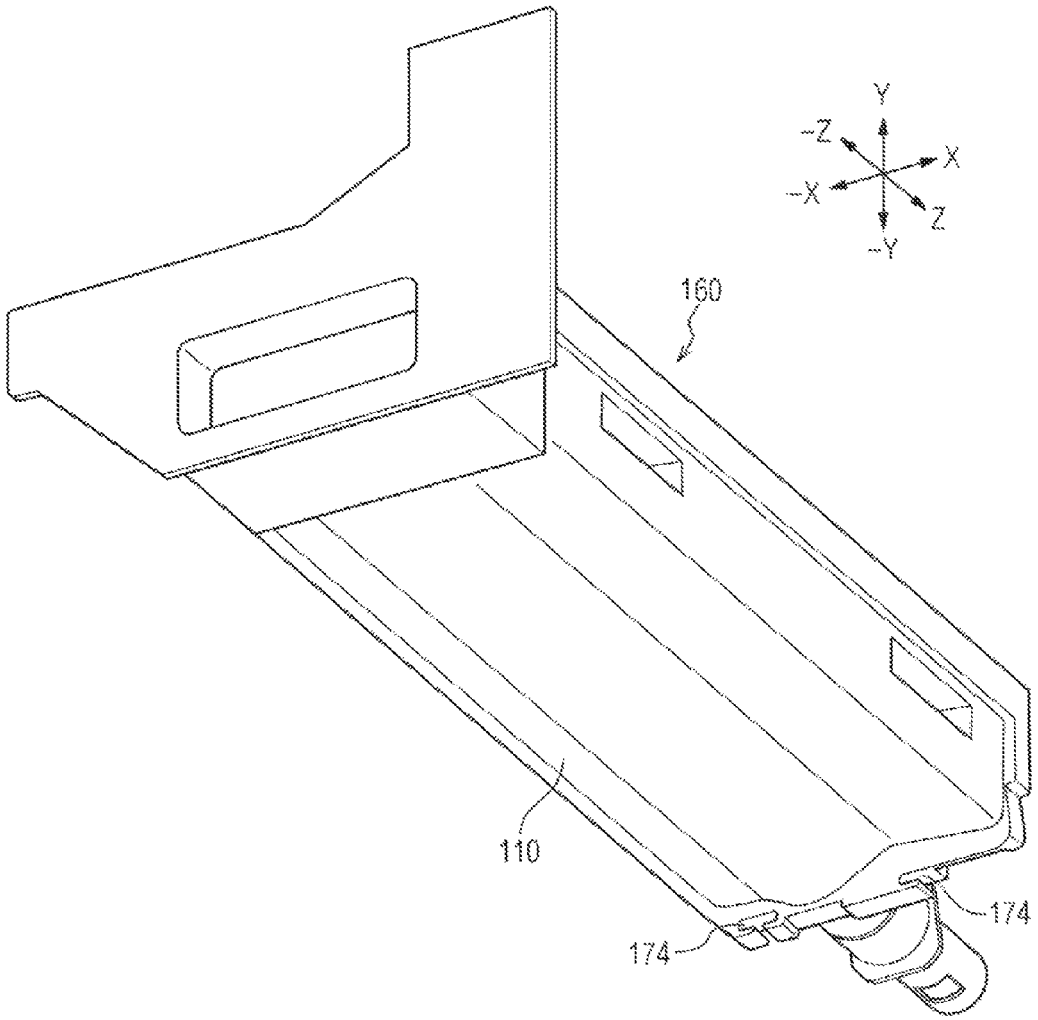
FIG. 8 is a perspective view illustrating the configuration of the removal device unit according to this exemplary embodiment.

Furthermore, as shown in FIGS. 5 and 6, a removal device unit 160 including the removal device 60 and the constituent member 110 is detachable from the intermediate transfer unit 150. As shown in FIGS. 3 and 7, a guide 172 (rail member) that guides the removal device unit 160, which is to be ejected in the −Z direction from the intermediate transfer unit 150, in the ejecting direction is provided at the Y side (upper side) of the body portion 92 of the receiver 90. The guide 172 is T-shaped when viewed in the Z direction. As shown in FIG. 8, a guided member 174 that is guided along the guide 172 is provided at the −Y side of the constituent member 110. The guided member 174 is guided in the −Z direction by the guide 172 so that the removal device unit 160 is pulled out in the −Z direction from the intermediate transfer unit 150, whereby the removal device unit 160 becomes detached from the intermediate transfer unit 150.

In this case, the X-side ends of the housing 80 and the constituent member 110 are pulled out in the −Z direction from the lower end of the connection duct 124. In other words, the connection duct 124 remains in the intermediate transfer unit 150 (see FIG. 7).

Operation According to Exemplary Embodiment

Next, the operation according to this exemplary embodiment will be described.

In this exemplary embodiment, the brush 64 loosens extraneous matter adhered on the outer peripheral surface of the intermediate transfer belt 24 and scrapes off a portion of the extraneous matter therefrom. Furthermore, the edge 71A of the first blade 71 rubs against the outer peripheral surface of the intermediate transfer belt 24 so as to scrape off the extraneous matter not removed by the brush 64. Moreover, the edge 72A of the second blade 72 rubs against the outer peripheral surface of the intermediate transfer belt 24 so as to scrape off the extraneous matter not removed by the first blade 71.

The extraneous matter scraped off by and dropping from the edge 71A of the first blade 71 and the extraneous matter dropping from the brush 64 via the dropper portion 66 are accommodated within the accommodation chamber 88A. The extraneous matter accommodated within the accommodation chamber 88A is transported toward the discharge portion (not shown) by the transport member 67.

For example, in a case where the discharge portion (not shown) and the accommodation chamber 88A become saturated, the extraneous matter accommodated in the accommodation chamber 88A may sometimes spill out from the V-shaped portion 84 in the −X direction over the seal member 69. Moreover, in a case where extraneous matter is peeled off from the intermediate transfer belt 24 by the seal member 69 before reaching the brush 64, the extraneous matter may sometimes spill out from the V-shaped portion 84 in the −X direction.

Then, the receiver 90 receives the extraneous matter spilling out from the V-shaped portion 84 in the −X direction. Thus, the extraneous matter may be prevented from dropping onto, for example, a recording medium P in the transport path 48.

In this exemplary embodiment, the first blade 71 and the second blade 72 rub against the intermediate transfer belt 24 so as to generate frictional heat. This frictional heat is cooled in the following manner.

Specifically, the fan 120 takes in outside air existing outside the image-forming-apparatus body 11 and sends the outside air in the direction indicated by the arrow A shown in FIG. 3. Furthermore, as indicated by the arrow B in FIG. 4, the outside air flows through the cooling path 100 in the Z direction and is discharged from the outlet 128. Thus, the frictional heat is cooled from the outside of the housing 80, thereby suppressing the occurrence of a phenomenon (blocking phenomenon), such as toner cohesion occurring due to fusion of toner surfaces or toner fixation on the components within the apparatus.

In this exemplary embodiment, the cooling path 100 is a chamber that is enclosed except for the duct 122 as an inlet and the outlet 128. Specifically, the cooling path 100 is spatially isolated from the passage chamber T through which extraneous matter dropping from the housing 80 toward the receiver 90 passes, the extraneous-matter accommodation chambers 83A and 88A in the housing 80 (i.e., internal chambers of the housing 80), and the chamber above the receiver 90 that receives extraneous matter (i.e., the chamber between the receiver 90 and the constituent member 110). Therefore, the outside air taken in by the fan 120 is not sent to chambers where extraneous matter exists, thereby suppressing scattering of extraneous matter. Consequently, with the configuration according to this exemplary embodiment, scattering of extraneous matter may be suppressed in a configuration that cools the housing 80 that accommodates extraneous matter.

Furthermore, in this exemplary embodiment, when the intermediate transfer unit 150 is ejected from the image-forming-apparatus body 11 (as an example of an apparatus body) for performing maintenance on the components included in the intermediate transfer unit 150 or for replacing the components, the housing 80 and the constituent member 110 are integrally ejected.

Moreover, when the removal device unit 160 is ejected from the intermediate transfer unit 150 (as an example of an apparatus body) for performing maintenance on the components included in the removal device unit 160 or for replacing the components or the entire unit, the housing 80 and the constituent member 110 are integrally detached.

Therefore, the housing 80 and the constituent member 110 do not have to be made separable from each other. On the other hand, for example, in a comparative example in which the constituent member 110 is configured to remain in the image-forming-apparatus body 11 or the removal device unit 160 when ejecting the intermediate transfer unit 150 or detaching the removal device unit 160, the housing 80 and the constituent member 110 have to be made separable from each other. This may make it difficult to fix the constituent member 110 onto the housing 80, possibly causing a gap to form between the housing 80 and the constituent member 110.

In contrast, in this exemplary embodiment, the housing 80 and the constituent member 110 are fixed to each other so that the occurrence of a gap between the housing 80 and the constituent member 110 may be suppressed. Therefore, the cooling path 100 is maintained as an enclosed chamber, thereby effectively suppressing scattering of extraneous matter.

Furthermore, in this exemplary embodiment, the cooling path 100 is displaced in the X direction (i.e., in the lateral direction) relative to the passage chamber T in plan view. Therefore, as compared with a case where the cooling path 100 and the passage chamber T coincide with each other in plan view, the dropping of extraneous matter from the housing 80 toward the receiver 90 may be prevented from being hindered by the cooling path 100. In other words, scattering of extraneous matter within the image-forming-apparatus body 11 caused by the extraneous matter dropping onto components other than the receiver 90 may be suppressed.

Furthermore, in this exemplary embodiment, the guide 172 that guides the removal device unit 160, which is to be ejected in the −Z direction from the intermediate transfer unit 150, in the ejecting direction is provided at the receiver 90 so that the number of components may be reduced, as compared with a case where the guide 172 is provided separately from the receiver 90.

Modifications

In the exemplary embodiment described above, the intermediate transfer unit 150 is ejected from the image-forming-apparatus body 11 so that the removal device unit 160 is ejected together with the intermediate transfer unit 150 from the image-forming-apparatus body 11. However, the configuration is not limited to this. Alternatively, the removal device unit 160 alone may be configured to be ejected from the image-forming-apparatus body 11. The expression "a configuration in which the removal device unit 160 is ejectable from the image-forming-apparatus body 11" includes "a configuration in which the removal device unit 160 is ejectable from the image-forming-apparatus body 11 without being separated from the image-forming-apparatus body 11" and "a configuration in which the removal device unit 160 is detachable from the image-forming-apparatus body 11 by being separated from the image-forming-apparatus body 11 by being ejected from the image-forming-apparatus body 11".

Furthermore, in the exemplary embodiment described above, the fan 120 and the duct 122 remain in the image-forming-apparatus body 11 when the intermediate transfer unit 150 is ejected from the image-forming-apparatus body 11. Alternatively, the fan 120 and the duct 122 may be configured to be ejected integrally from the intermediate transfer unit 150.

Furthermore, in the exemplary embodiment described above, the intermediate transfer belt 24 is used as a bearing member that bears toner to be transferred onto a recording medium. Alternatively, the bearing member may be an intermediate transfer body, such as an intermediate transfer drum, or a transfer body, such as a photoconductor having a toner image (toner) to be directly transferred onto a recording medium P.

The present invention is not limited to the exemplary embodiment described above, and various modifications, alterations, and improvements are permissible. For example, multiple modifications described above may be combined, where appropriate.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A removal mechanism comprising:

a removing member that rubs against an extraneous-matter-adhered member, to which extraneous matter is adhered, so as to remove the extraneous matter therefrom;

an accommodation section that accommodates therein the extraneous matter removed by the removing member;

a receiver that receives, at a lower side of the accommodation section, the extraneous matter spilling out and dropping from the accommodation section; and a cooling path that allows gas to flow therethrough so as to cool the accommodation section from outside thereof, the cooling path being enclosed by a housing of the accommodation section, a constituent member provided between the accommodation section and the receiver, and sidewalls, thereby spatially isolating the cooling path from a passage chamber through which the extraneous matter dropping from the accommodation section toward the receiver passes, an accommodation chamber for the extraneous matter in the accommodation section, and a chamber above the receiver that receives the extraneous matter.

2. The removal mechanism according to claim 1, wherein the constituent member is ejectable together with the accommodation section from an apparatus body.

3. The removal mechanism according to claim 1, wherein the cooling path is displaced in a lateral direction relative to the passage chamber in plan view.

4. The removal mechanism according to claim 1, further comprising:

a guide that is formed at the receiver and that guides a constituent member, which is ejectable together with the accommodation section, in an ejecting direction.

5. An image forming apparatus comprising:

a bearing member that bears toner to be transferred onto a recording medium; and the removal mechanism according claim 1 that rubs against the bearing member acting as an extraneous-matter-adhered member, to which the toner is adhered as extraneous matter, so as to remove the toner therefrom.

6. The removal mechanism according to claim 1, wherein the constituent member is attached, at a distal end of the cooling path from an air-sending unit, to the housing.

* * * * *